US005924689A

United States Patent [19]

Fukai et al.

[11] Patent Number: 5,924,689

[45] Date of Patent: Jul. 20, 1999

[54] SHEET SORTER WITH STAPLER

[75] Inventors: Shigeki Fukai, Tokyo; Tsunemitsu Kazama, Yamanashi-ken, both of Japan

[73] Assignee: Riso Kagaku Corporation, Tokyo, Japan

[21] Appl. No.: 08/853,590

[22] Filed: May 9, 1997

[30] Foreign Application Priority Data

May 13, 1996 [JP] Japan ..... 8-117519

[51] Int. Cl.[6] ..... B65H 39/10; B65H 39/02

[52] U.S. Cl. ..... 271/294; 271/292; 270/58.08; 270/58.14; 270/58.26

[58] Field of Search ..... 271/37, 292, 293, 271/294; 270/58.09, 58.08, 58.14, 58.19, 58.26, 58.28

[56] References Cited

U.S. PATENT DOCUMENTS

| | | | |
|---|---|---|---|
| Re. 35,087 | 11/1995 | Uto et al. | 270/58.19 |
| 5,044,625 | 9/1991 | Reid | 270/58.16 |
| 5,090,673 | 2/1992 | Kitahara et al. | 270/58.19 |
| 5,152,511 | 10/1992 | Shido et al. | 270/58.19 |
| 5,222,721 | 6/1993 | Miura et al. | 270/58.19 |
| 5,255,908 | 10/1993 | Hiroi et al. | 270/58.19 |
| 5,382,012 | 1/1995 | Mandel et al. | 271/293 |
| 5,434,661 | 7/1995 | Takahashi et al. | 270/58.08 |
| 5,449,167 | 9/1995 | Takehara et al. | 271/296 |
| 5,542,655 | 8/1996 | Murakami | 270/58.09 |
| 5,556,251 | 9/1996 | Hiroi et al. | 270/58.28 |
| 5,580,039 | 12/1996 | Takehara et al. | 270/58.11 |
| 5,651,537 | 7/1997 | Morii et al. | 270/58.28 |
| 5,673,906 | 10/1997 | Furuya et al. | 270/58.28 |
| 5,806,850 | 9/1998 | Yoneoka et al. | 271/296 |

FOREIGN PATENT DOCUMENTS

| | | |
|---|---|---|
| 0198970 | 10/1986 | European Pat. Off. . |
| 0298510 | 1/1989 | European Pat. Off. . |
| 0437646 | 7/1991 | European Pat. Off. . |

*Primary Examiner*—William E. Terrell
*Assistant Examiner*—Wonki Park
*Attorney, Agent, or Firm*—Sixbey, Friedman, Leedom & Ferguson, PC; Donald R. Studebaker

[57] ABSTRACT

A sheet sorter with a stapler includes bins arranged in a vertical direction each of which receives a plurality of sheets discharged from an image recording apparatus to form a stack of sheets. An indexer receives the sheets from the image recording apparatus and is movable up and down along the array of sheet inlet ends of the bins to distribute the sheets to the respective bins through the sheet inlet ends. A stapler is movable along the path of travel of the indexer independently therefrom to staple the stack of sheets on each bin. The stapler is arranged to wait in a waiting position retracted from the path of travel of the indexer in a direction of width of the sheets while the indexer is travelling along the path.

3 Claims, 11 Drawing Sheets

SHEET SORTER WITH STAPLER

BACKGROUND OF THE INVENTION

1. Field of the Invention

This invention relates to a sheet sorter with a stapler, and more particularly to a sheet sorter which is provided with a plurality of bins each of which receives a plurality of sheets discharged from an image recording apparatus such as a printer, a copier or the like and forms thereon a stack of sheets, and a stapler for stapling or binding the sheet stack on each bin.

2. Description of the Related Art

As disclosed, for instance, in Japanese Unexamined Patent Publication No. 4(1992)-43089, there has been known a sheet sorter in which a plurality of recorded sheets discharged from an image recording apparatus such as a printer, a copier or the like are distributed to a plurality of bins or sort trays in sequence to form a stack of sheets on each bin by a sheet distributor called an indexer and when the number of the sheets stacked on each of the bins reaches a predetermined value, the sheet stack on each of the bins is stapled by a stapler which is movable along the path of travel of the indexer independently therefrom.

However the conventional sheet sorter with a stapler is disadvantageous in that the stapler is arranged to wait in a waiting position downwardly retracted from the lower end of the path of travel of the indexer while the indexer is traveling along the path, which deteriorates the space efficiency and limits the number of the bins which can be provided in the frame of the sheet sorter of a given height.

SUMMARY OF THE INVENTION

In view of the foregoing observations and description, the primary object of the present invention is to provide a sheet sorter with a stapler in which the bins can be arranged independently of existence of the stapler.

The sheet sorter with a stapler in accordance with the present invention comprises a plurality of bins arranged in a vertical direction each of which receives a plurality of sheets discharged from an image recording apparatus and forms thereon a stack of sheets, a sheet transfer means which transfers the sheets discharged from the image recording apparatus, an indexer which receives the sheets from the sheet transfer means and is movable up and down along the array of sheet inlet ends of the bins to distribute the sheets to the respective bins through the sheet inlet ends thereof, and a stapler which is movable along the path of travel of the indexer independently therefrom to staple the stack of sheets on each bin, and is characterized in that the stapler is arranged to wait in a waiting position retracted from the path of travel of the indexer in a direction of width of the sheets while the indexer is travelling along the path.

It is preferred that the waiting position of the stapler be on the side of the sheet sorter where the operator of the sheet sorter stands when operating the sheet sorter.

In accordance with the present invention, since the waiting position of the stapler is retracted from the path of travel of the indexer in a direction of width of the sheets and the path of travel of the indexer partly overlaps with the waiting position of the stapler as seen laterally to the path of travel of the indexer, the space efficiency is improved and the arrangement of bins can be determined independently of existence of the stapler. That is, the number of the bins can be increased for a given height of the sheet sorter and the height of the sheet sorter can be reduced for a given number of bins.

When the waiting position of the stapler is on the side of the sheet sorter where the operator of the sheet sorter stands when operating the sheet sorter, replacement and/or adjustment of staples can be carried out while the indexer is distributing the sheets to the bins, and accordingly interruption and the like of the operation of the sheet sorter can be reduced and the working efficiency is increased.

DESCRIPTION OF THE PREFERRED EMBODIMENT

Figure 1:
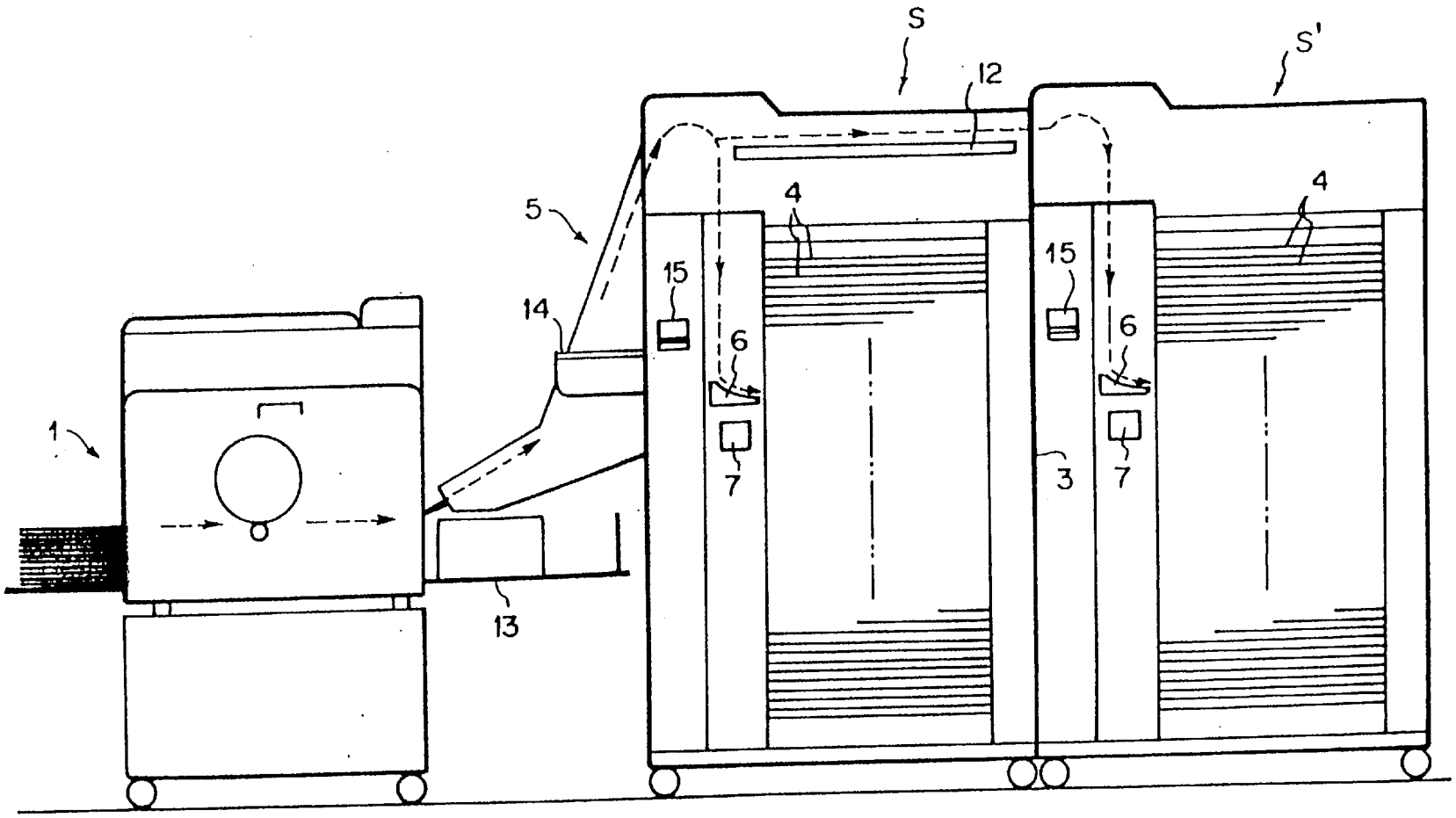
FIG. 1 is a schematic side view showing a sheet sorter with a stapler in accordance with an embodiment of the present invention with the sorter connected to an image recording apparatus.
Figure 2:
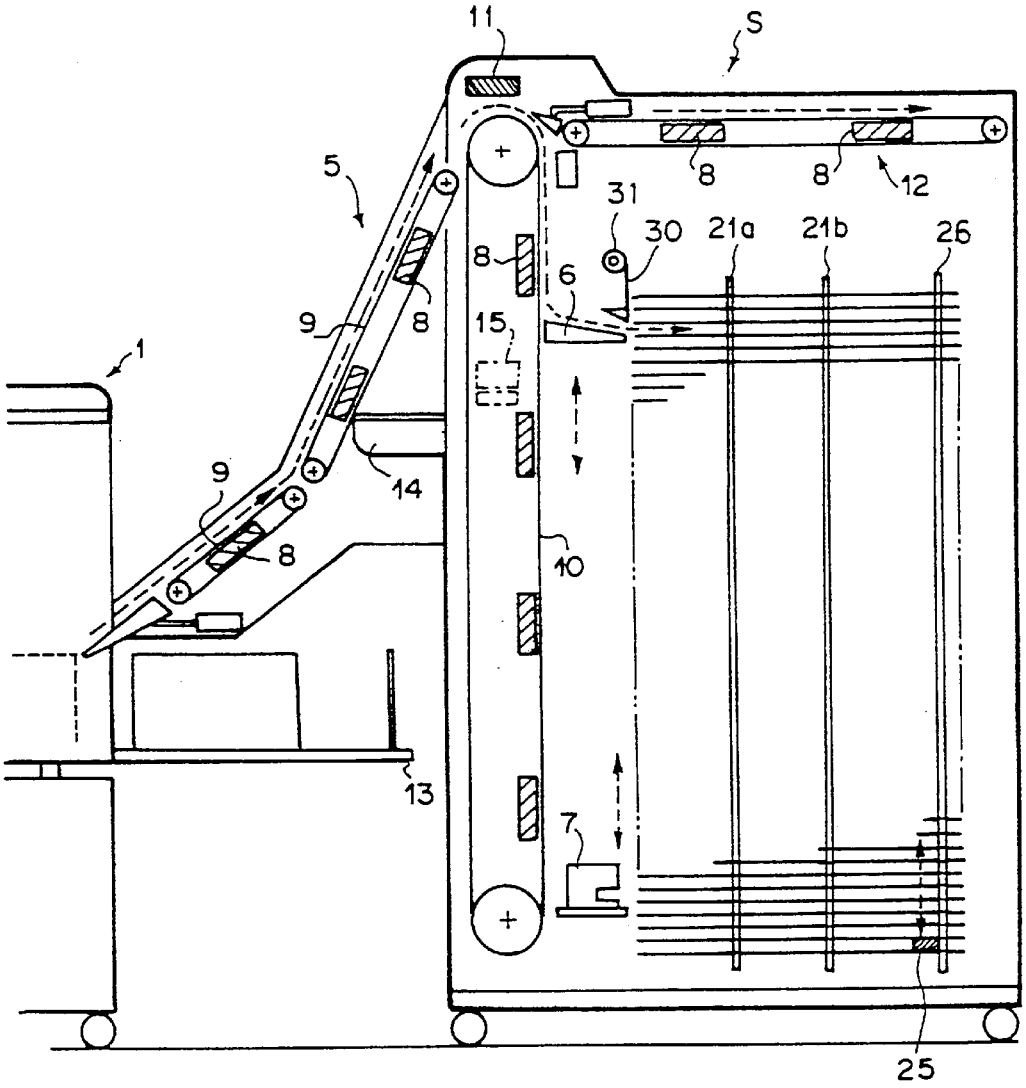
FIG. 2 is a side through-view showing the internal structure of the sorter shown in FIG. 1.

In FIGS. 1 to 4, a sheet sorter S comprises a plurality of (e.g., fifty) bins (sort trays) 4 which are disposed in fixed positions in a frame 3 at predetermined intervals in the vertical direction and receive a plurality of recorded sheets 2 (FIG. 3) discharged from an image recording apparatus 1 such as a printer to form a stack of the sheets 2 on each bin 4, a sheet transfer means 5 which transfers the sheets 2 discharged from the image recording apparatus 1 toward the bins 4, an indexer 6 which is movable up and down along the array of the sheet inlet ends 4*a* of the bins 4 and distributes the sheets 2 transferred by the sheet transfer means 5 to the respective bins 4, and a stapler 7 which is movable along the path of travel of the indexer 6 independently of the indexer 6.

In the case where the image recording apparatus 1 is a printer, especially a stencil printer, a number of sheets can be printed in a short time and recorded sheets 2 carrying thereon wet ink are discharged at a high rate. Accordingly no conveyor roller is used in the sheet transfer means 5 and the sheet transfer means 5 comprises a perforated conveyor belts 9 and 10 which convey the sheets 2 with the back side of the sheets 2 attracted against the belts 9 and 10 under vacuum applied by blowers 8 and a fan 11 which presses the sheets 2 against the belt 10 under an air pressure as clearly shown in FIG. 2.

In this particular embodiment, the sheet sorter S is arranged so that a plurality of slaves S' having the same structure as the main sheet sorter S can be connected to the sheet sorter S as shown in FIG. 1 in order to increase the total number of the bins 4. The slaves S' are connected to the main sheet sorter S on the side remote from the image recording apparatus 1. A sheet conveyor 12 is demountably mounted on an upper portion of the main sheet sorter S and the sheets 2 in the main sheet sorter S are transferred to the slaves S' by the sheet conveyor 12 when the slaves S' are connected to the main sheet sorter S.

The image recording apparatus 1 is provided with a sheet tray 13 on which the discharged sheets 2 are stacked when sorting of the sheets 2 is not necessary. Further a control panel 14 and an exterior electric stapler 15 are mounted on the outer surface of the sheet sorter S.

Figure 3:
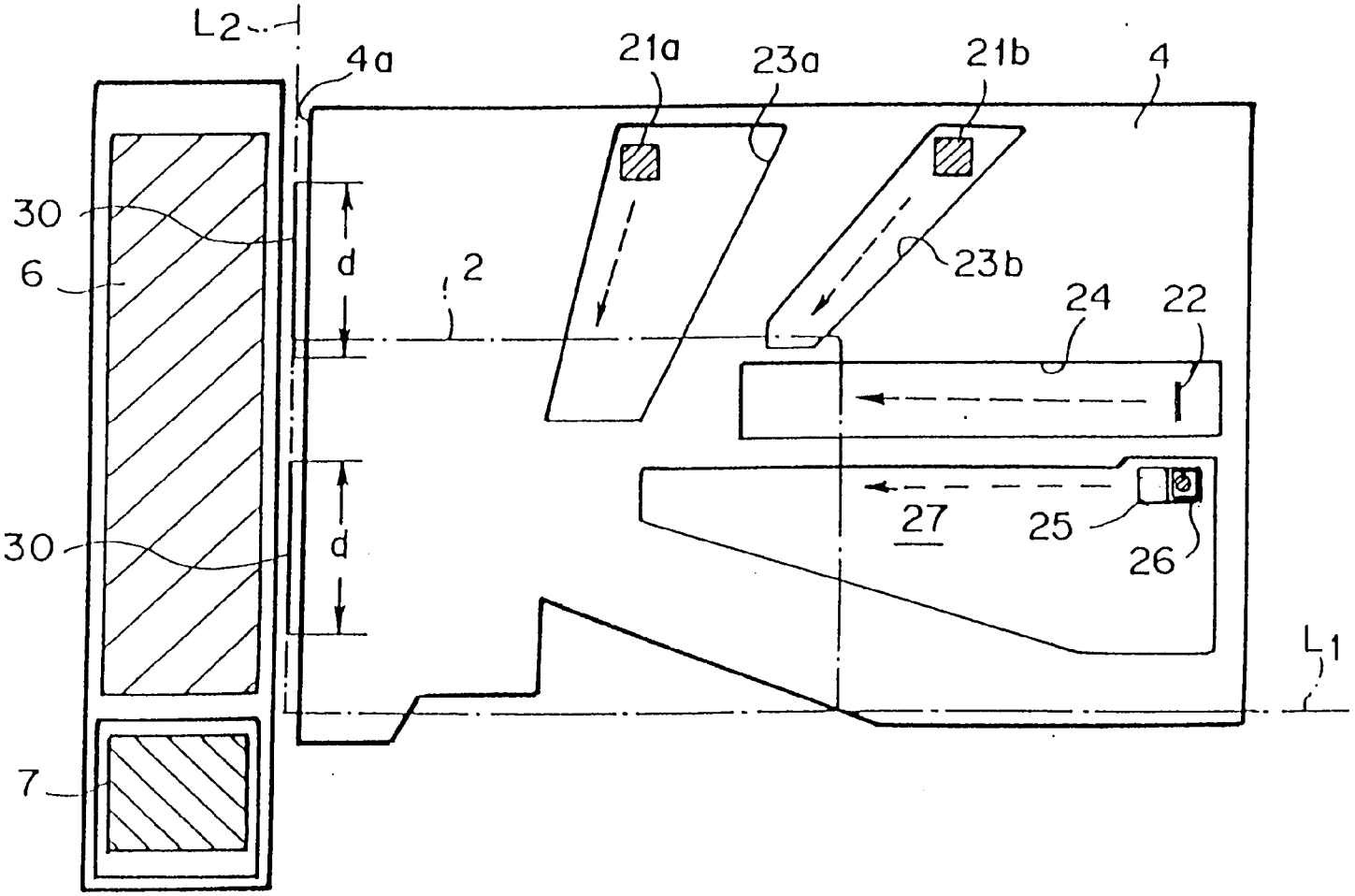
FIG. 3 is a schematic plan view showing the arrangement of the bins, indexer, stapler, sheet stack ejector and the like in the sorter shown in FIG. 1.

As shown in FIG. 3, the stapler 7 waits in a waiting position retracted the path of the indexer 6 in a direction of width of the sheets 2 (in a vertical direction as seen in FIG. 3) while the indexer 6 is moving up and down. The waiting position of the stapler 7 is such that the indexer 6 is brought into alignment with the stapler 7 or overlaps with the stapler 7 as seen in a side view of the sheet sorter S when the indexer 6 is moved to a position where it can distribute a sheet 2 to the lowermost bin 4.

Figure 4:
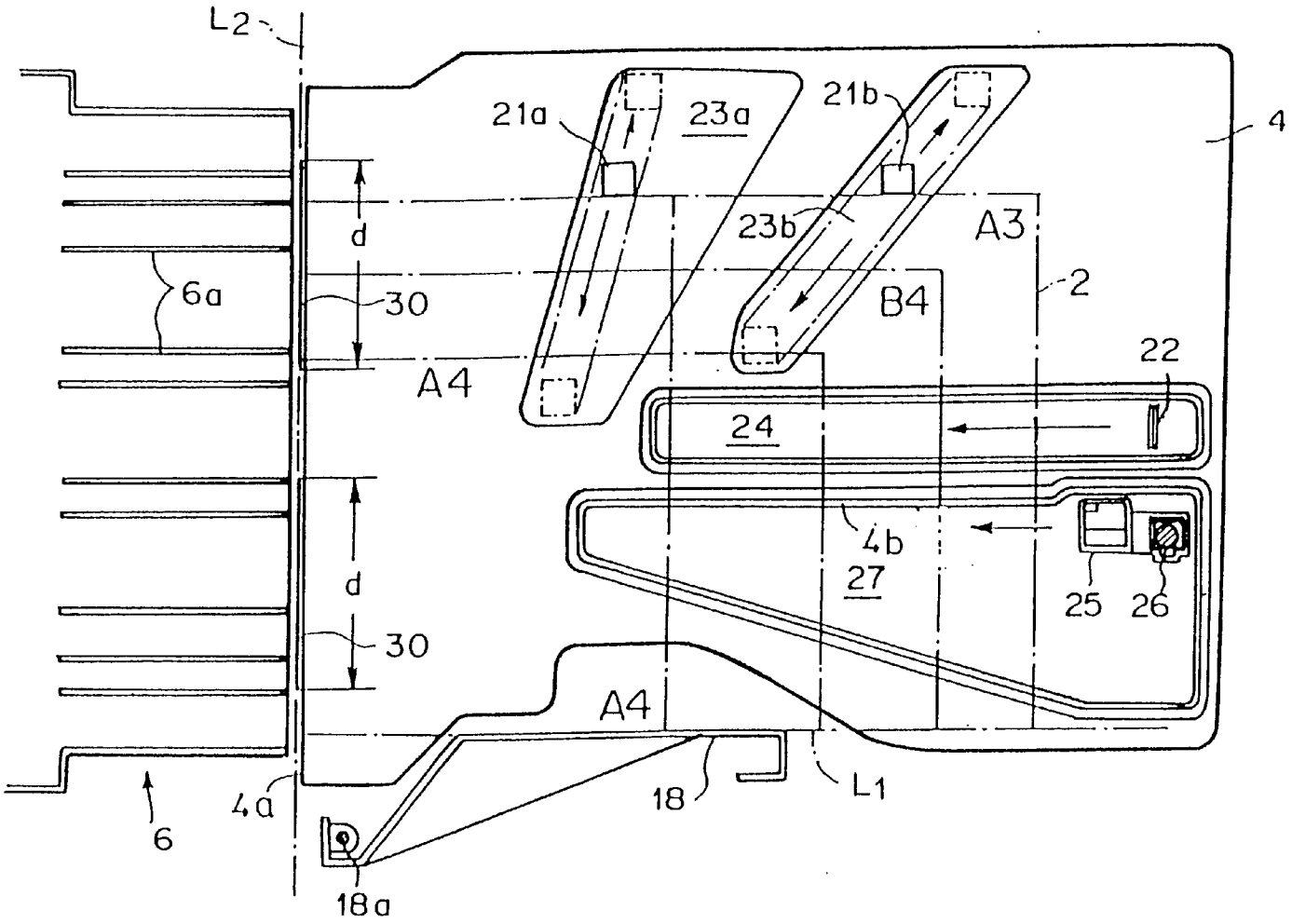
FIG. 4 is an enlarged view of a part of FIG. 3.

As shown in FIG. 4, side edges of the sheets 2 placed on each bin 4 are lined up along a side edge reference surface L1 defined by the inner surface of a sheet stack take-out door 18 which is rotatable about a pin 18*a*. For this purpose, there vertically extend through the plurality of bins 4 a pair of side lineup rods 21*a* and 21*b* which push the sheet 2 in the direction of width of the sheet 2 and bring the side edge of the sheet 2 into abutment against the side edge reference surface L1, a stopper member 22 of a resilient material such as rubber band which the leading edge of the sheet 2, which is released into the bin 4 at a high speed from the indexer 6, is brought into abutment against, thereby gently stopping the sheet 2, and a guide rail 26 along which a sheet stack ejector 25 (to be described later) is moved up and down.

The side lineup rods 21*a* and 21*b* and the stopper member 22 are moved respectively along slots 23*a*, 23*b* and 24. The stopper member 22 is moved along the slot 24 left and right as seen in FIG. 4 according to the size of the sheets 2 to be released from the indexer 6.

The guide rail 26 doubles as a lineup rod which pushes the leading edge of the sheet 2 to move the sheet 2 toward the sheet inlet end 4*a* of the bin 4 so that the trailing edge of the sheet 2 is brought into abutment against a trailing edge reference surface L2. For this purpose, the guide rail 26 is provided with a flat vertical surface 26*a* facing toward the sheet inlet end 4*a* of the bin 4. The guide rail 26 is moved left and right as seen in FIG. 4 by a drive mechanism (not shown) in an opening 27 formed in the bin 4.

As shown in FIG. 4, the side lineup rods 21*a* and 21*b* are moved by a drive mechanism (not shown) at angles to the direction in which the sheet 2 is fed into the bin 4 so that they are simultaneously moved toward and away from both the reference surfaces L1 and L2 and can act on various sizes of the sheets 2 in optimum positions according to the size of the sheets 2 handled. Further the angle at which the path of the side lineup rod 21*b*, which is at a larger distance from the trailing edge reference surface L2, is inclined to the feeding direction of the sheet 2 is smaller than that of the other side lineup rod 21*a*, and accordingly as the rods 21*a* and 21*b* are moved toward the side edge of the sheet 2, the distance between the rods 21*a* and 21*b* becomes smaller.

After completion of distribution of the sheets 2 to all the bins 4 by the indexer 6, the sheet stacks 20 (FIG. 7) on the respective bins 4 are ejected toward the stapler 7 beyond the trailing edge reference surface L2 in sequence for stapling operation. For this purpose, a sheet stack ejector 25 is provided. The sheet stack ejector 25 can be moved by a drive mechanism (not shown) up and down in the openings 27 of the respective bins 4 along the guide rail 26 when the guide rail 26 is in the rightmost position shown in FIG. 4.

When the sheet stack 20 on one of the bins 4 is to be stapled, the sheet stack 20 on the bin 4 must be ejected from the sheet inlet end 4*a* of the bin 4 by a predetermined length, and accordingly the sheet stack ejector 25 is provided with an ejecting surface positioned at a distance not smaller than the predetermined length from the vertical surface of the guide rail 26. When the guide rail 26 brings the trailing edges of the sheets 2 into alignment with each other on the trailing edge reference surface L2, the sheet stack ejector 25 is moved upward or downward along the guide rail 26 to a position where the sheet stack ejector 25 does not interfere with the lineup operation of the guide rod 26.

When stapling the sheet stack 20 on a selected bin 4, the sheet stack ejector 25 is first moved along the guide rail 26 to a predetermined position suitable for ejecting the sheet stack 20 on the selected bin 4 and the guide rail 26 is moved toward the sheet inlet end 4*a* of the selected bin 4 from the position shown in FIG. 4. As the guide rail 26 is moved toward the sheet inlet end 4*a*, the sheet stack ejector 25 comes to be engaged with both the upper surface of a linear edge portion 4*b* (FIG. 4) of the opening 27 of the selected bin 4 and the lower surface of the linear edge portion 4*b* of the bin 4 just above the selected bin 4. Thus the sheet stack ejector 25 ejects the sheet stack 20 on the selected bin 4 toward the stapler 7 while moving toward the stapler 7 under the guidance of the surfaces of the engagement portions 4*b* of the adjacent bins 4 held therebetween.

Referring also to FIGS. 5 to 8, the stapler 7 will be described in detail, hereinbelow.

Figure 5:
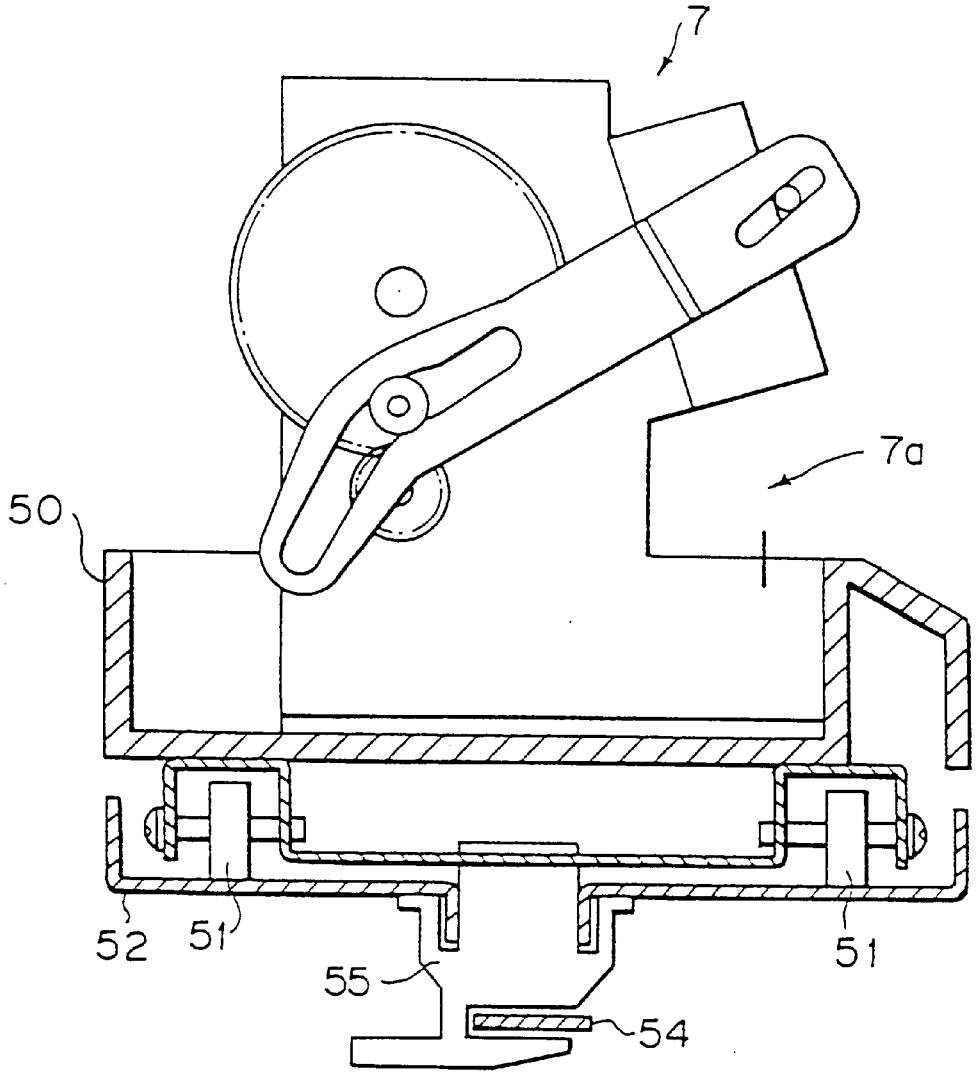
FIG. 5 is a side view partly in cross-section of the stapler.
Figure 6:
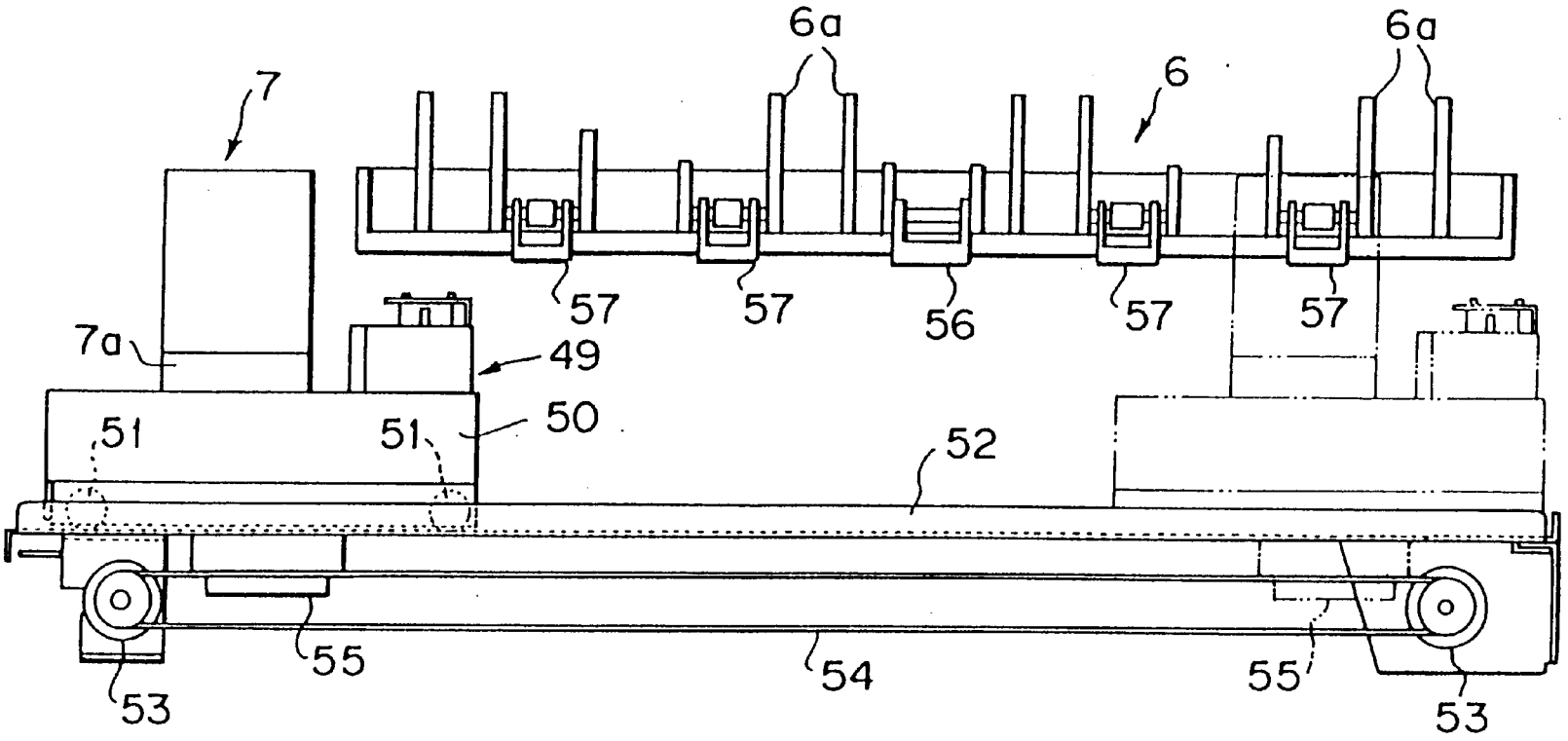
FIG. 6 is a front view as seen from the indexer side showing the relation between the indexer in the lowermost position and the stapler in the waiting position.

The stapler 7 is provided with a throat 7*a* into which the sheet stack 20 is inserted when stapling the sheet stack 20. As shown in FIG. 5 and 6, the stapler 7 is mounted on a base table 50 having four wheels 51 at four corners of the bottom surface thereof. The base table 50 is placed on an elongated lift 52 which extends in the direction of width of the sheet 2 (left and right as seen in FIG. 6) and is moved up and down along the path of travel of the indexer 6 by a drive means (not shown). A pair of pulleys 53 are provided on opposite end portions of the lift 52 and an endless belt 54 is passes around the pulleys 53. A member 55 fixed to the base table 50 is connected to the endless belt 54. Thus the stapler 7 is moved left and right on the lift 52 driven by the endless belt 54, which is driven by an electric motor (not shown).

A sheet pusher mechanism 49 for returning the stapled sheet stack 20 into the bin 4 is provided on the base table 50.

Figure 7:
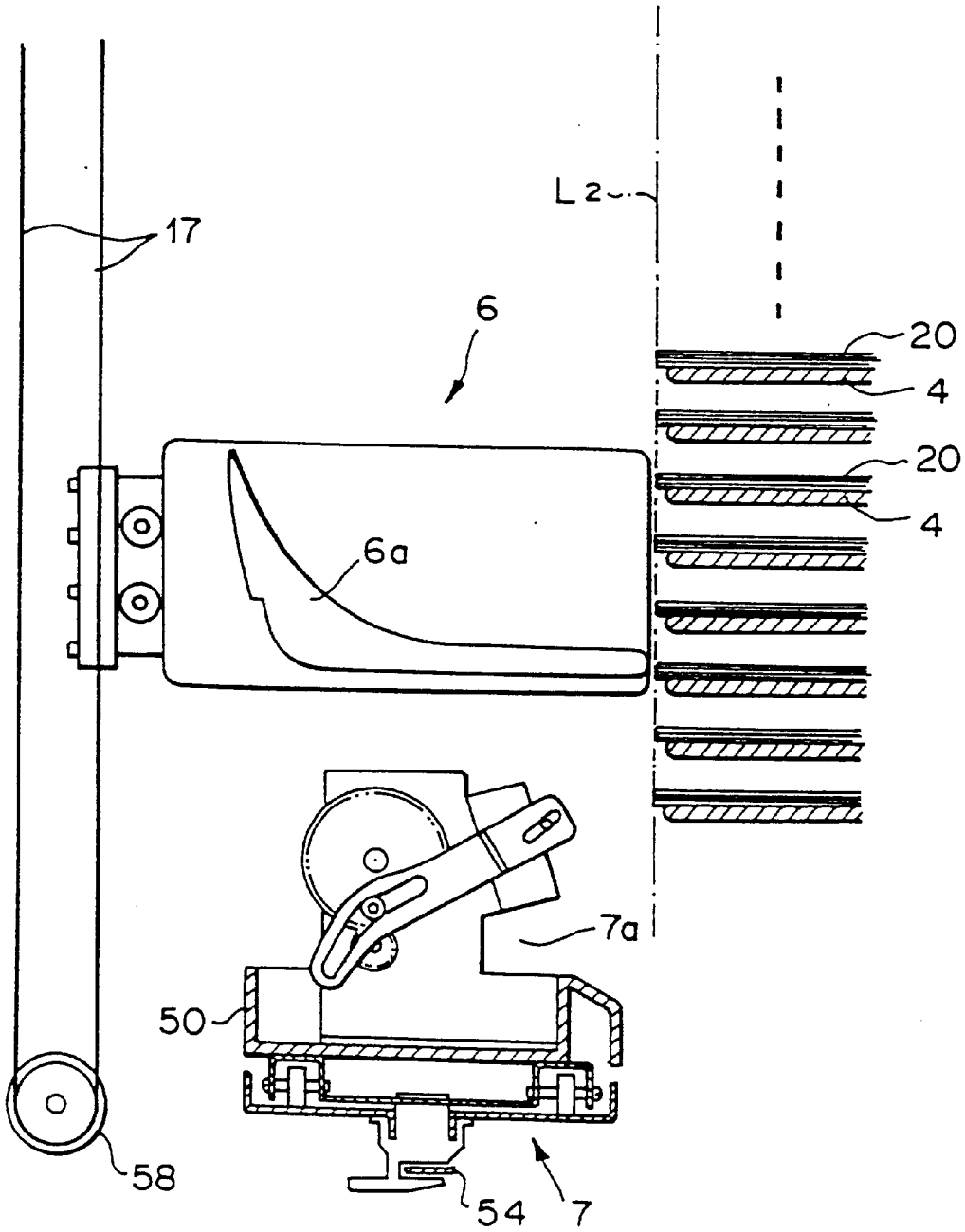
FIG. 7 is a schematic side view showing the state where the stapler is in the waiting position while the indexer is operating.
Figure 8:
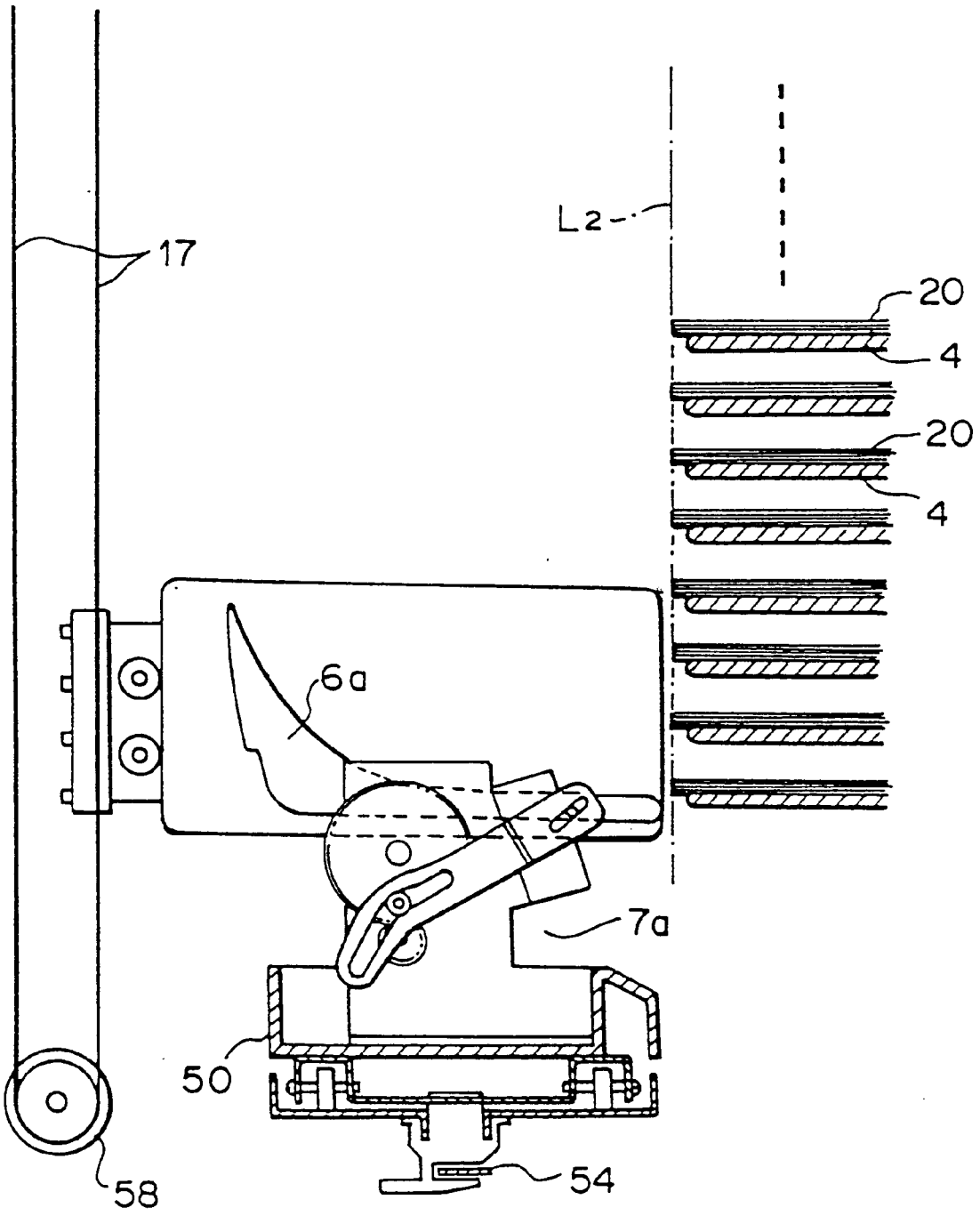
FIG. 8 is a schematic side view of FIG. 6.
Figure 9:
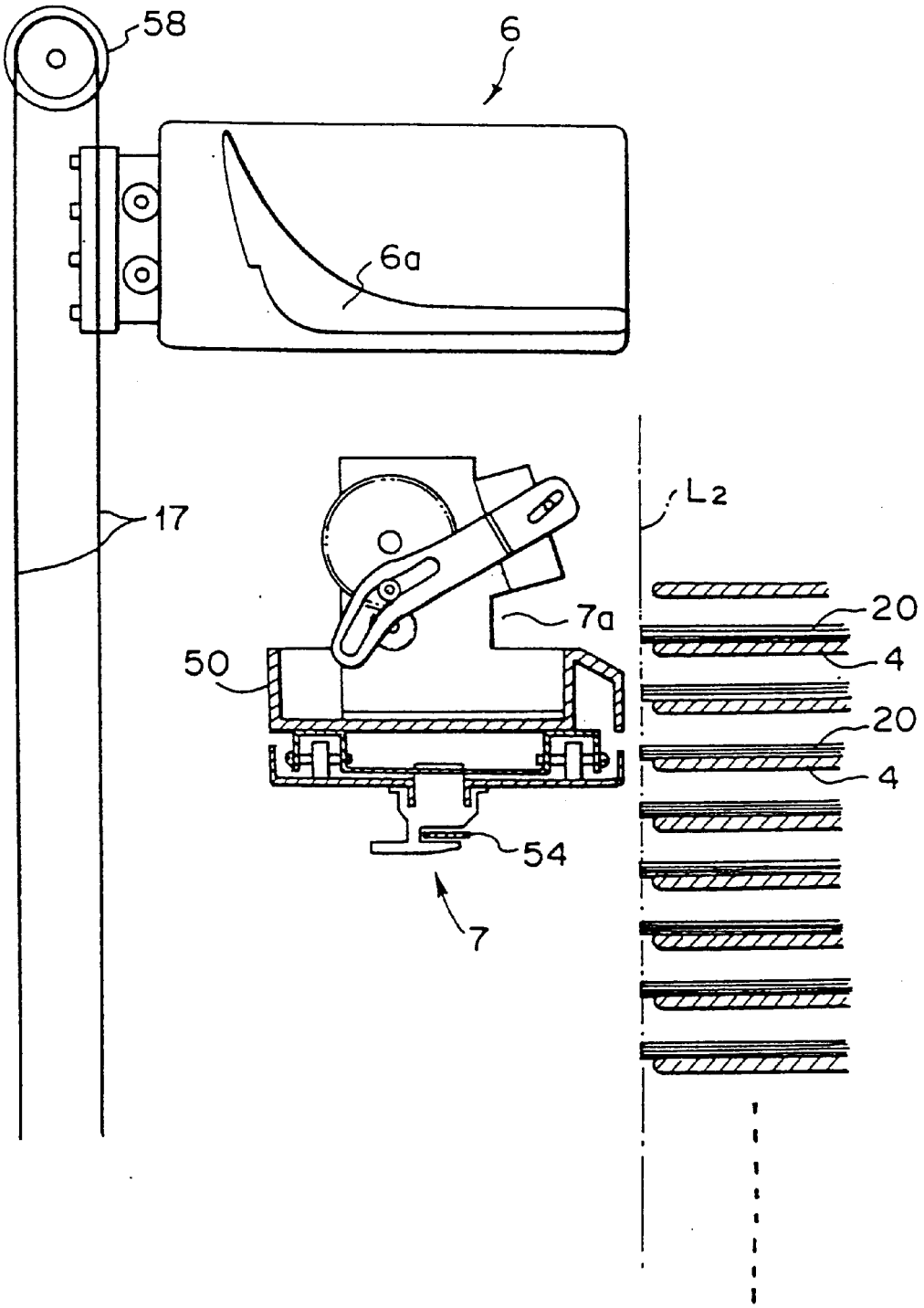
FIG. 9 is a schematic side view showing the state where the indexer is in the retracted position above the uppermost bin while the stapler is operating.

As shown in FIG. 6, the indexer 6 is provided with a plurality of sheet guide ribs 6*a* on the upper surface thereof. The indexer 6 is further provided with a single sheet bound preventing member 56 and four sheet retainers 57 on an edge portion opposed to the sheet inlet end 4*a* of the bin 4. The indexer 6 is moved up and down by an endless belt 17 passed around upper and lower pulleys 58 as shown in FIGS. 7 to 9. As shown in FIGS. 7 and 8, the stapler 7 is in the waiting position, which is the lowermost position thereof, when the indexer 6 is operating, and when the indexer 6 is in its lowermost position, the indexer 6 and the stapler 7 partly overlap with each other as seen from a side of the sheet sorter S as shown in FIG. 8.

When the stapler 7 operates, the indexer 6 is positioned in a retracted position above the uppermost bin 4.

Figure 10:
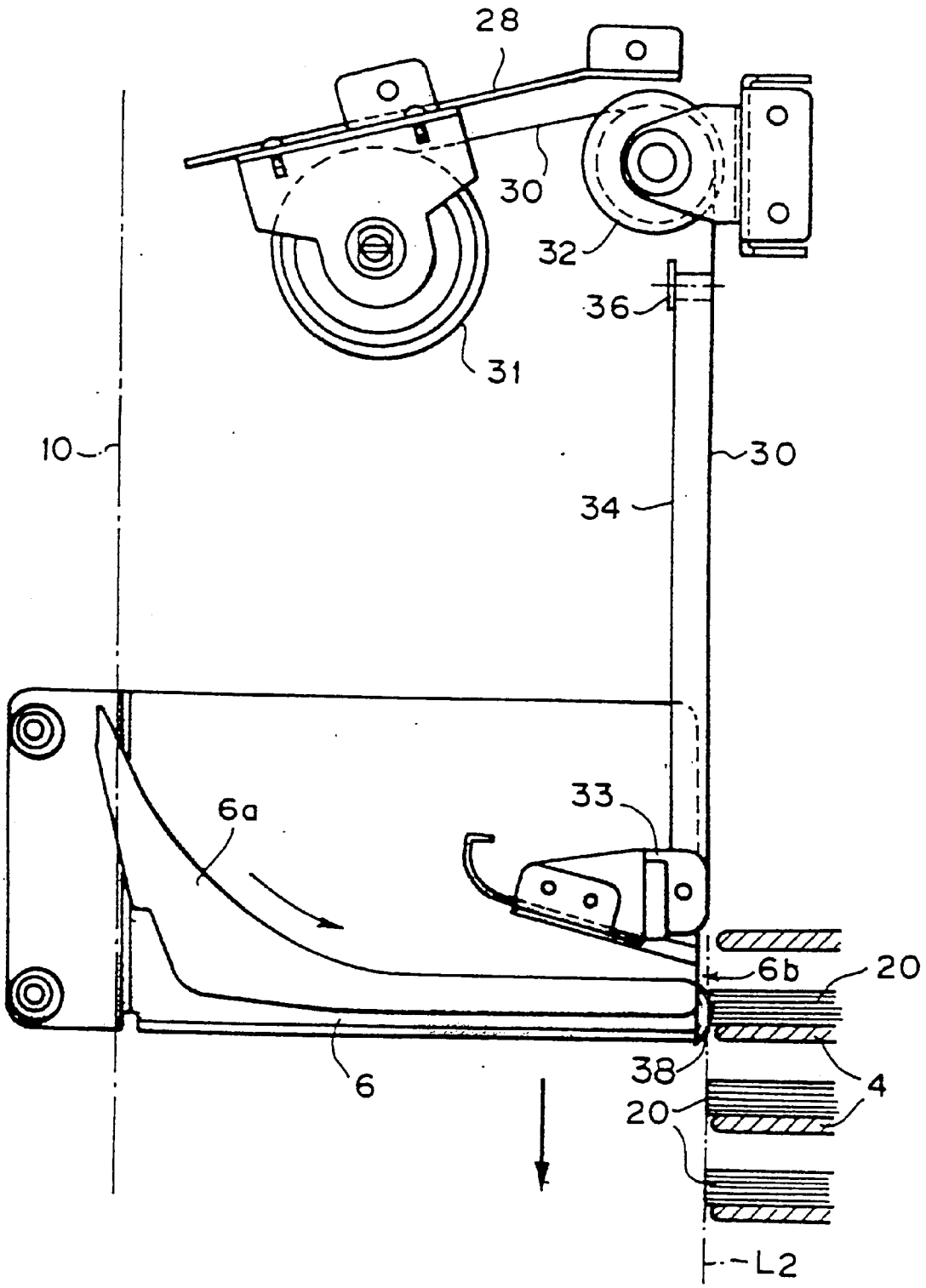
FIG. 10 is a side view showing the member for defining the trailing edge reference surface.
Figure 11:
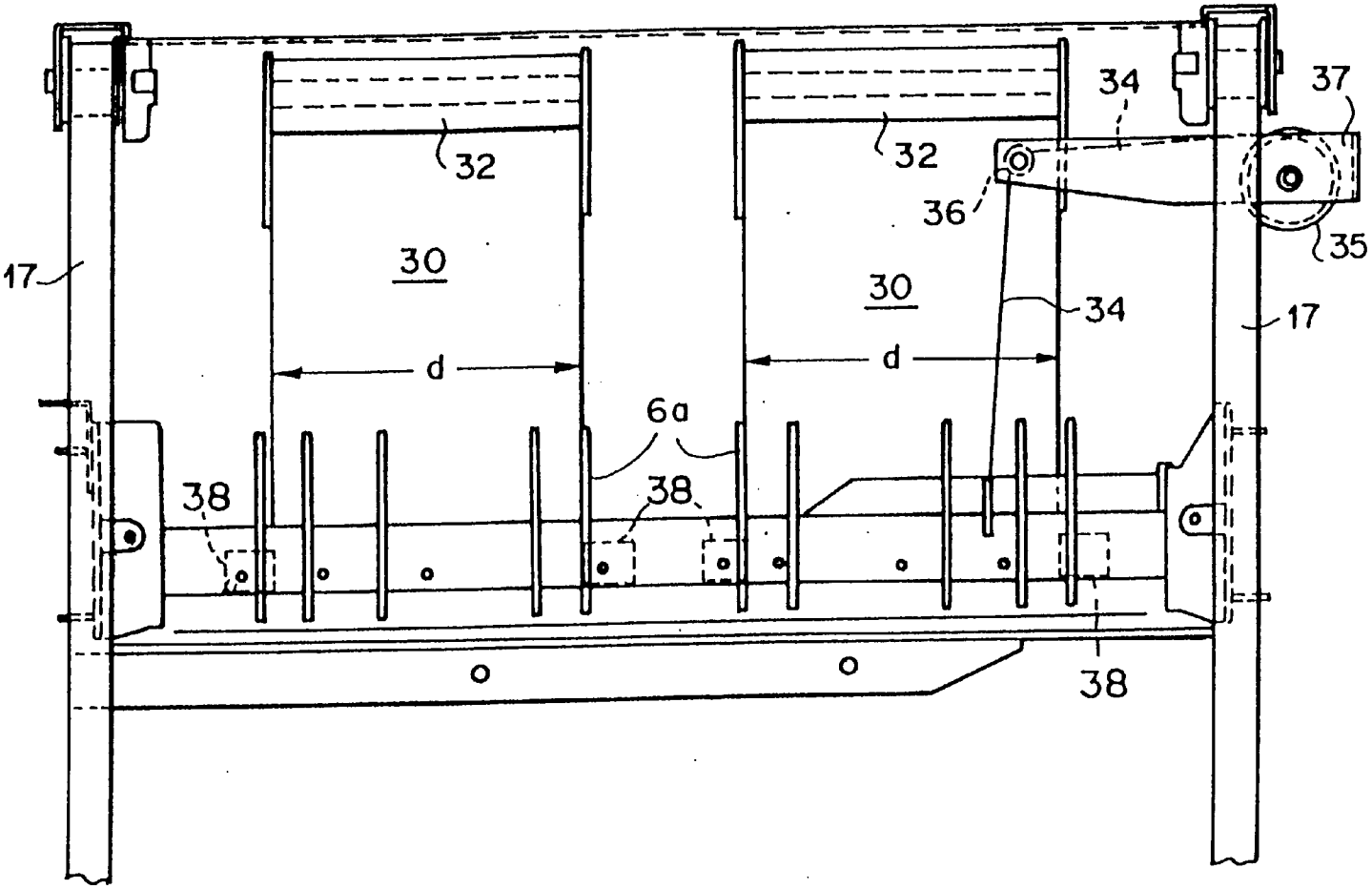
FIG. 11 is a front view as seen from the indexer side showing the same.

FIGS. 10 and 11 show a member for defining the trailing edge reference surface L2. As shown in FIGS. 4 and 11, the trailing edge reference surface L2 extends along the array of the sheet inlet ends 4*a* of the bins 4 and is defined by a pair of strip-like spring members 30 each having a width d. The spring member 30 is in a continuous length and fed out from a roll in a casing 31 (FIG. 10) which is fixed to the frame 3 by way of a bracket 28 above the uppermost position of the indexer 6. The part of the spring member 30 extending outside the casing 31 is passed around a reel 32 and extends right downward. The leading end of the spring member 30 is fixed to a fixing member 33 which is provided just above the sheet discharge port 6*b* of the indexer 6 close thereto.

Accordingly the spring members 30 are long fed out from the casing 31 as the indexer 6 moves downward and close the sheet inlet ends 4*a* of the bins 4 which are above the sheet discharge end 6*b* of the indexer 6, thereby forming the trailing edge reference surface L2. As the indexer 6 moves upward the spring members 30 are taken up into the casing 31.

In this particular embodiment, a second strip-like spring member 34 which is smaller than the spring member 30 in width is employed to reinforce the spring member 30, thereby holding flat the spring member 30. That is, the second spring member 34 is in a continuous length and fed out from a roll in a casing 35 which is fixed to the frame 3 by way of a bracket 37 so that the longitudinal axis of the casing 35 is substantially perpendicular to that of the casing 31 of the spring member 30. The part of the second spring member 34 extending outside the casing 35 is passed around a reel 36 and extends downward with its one side edge in contact with the indexer side surface of the spring member 30 substantially perpendicularly thereto. The leading end of the second spring member 34 is fixed to the indexer 6 at a portion above the sheet discharge port 6*b* of the indexer 6.

Also the second spring member 34 is fed out from the casing 35 as the indexer 6 moves downward and taken up into the casing as the indexer 6 moves upward. For instance, the second spring member 34 may be of a constant load spring such as "Conston®".

Further in this particular embodiment, as a means for assisting the spring members 32 in lining up the trailing edges of the sheets 2 in the sheet stack 20, hollow resilient members 38 are mounted on the indexer 6 below the sheet discharge port 6*b* on opposite sides of each spring member 20. The hollow resilient members 38 is formed of, for instance, "Mylar®". Each resilient member 38 arcuately bulges toward the bin 4 and has an inclined surface which presses the trailing edge of the sheet stack 20 toward the guide rail 26. In FIGS. 10 and 11, the sheet bound preventing member 56 and the sheet retainers 57 on the indexer 6 are omitted.

The operation of the sheet sorter S with the arrangement described above will be described, hereinbelow.

(1) First the indexer 6 is located in a position where the sheet discharge port 6*b* thereof is opposed to the sheet inlet end 4*a* of the uppermost bin 4 with the stapler 7 held in the waiting position laterally retracted from the path of the indexer 6 shown in FIGS. 6 to 8. At this time, the side lineup rods 21*a* and 21*b* are held in the respective retracted positions at a maximum distance from the side edge reference surface L1 and the stopper 22 is held in a position corresponding to the size of the sheets 2 to be discharged from the image recording apparatus 1. Further the guide rail 26 is held in the position shown in FIG. 4 with the sheet stack ejector 25 held in the opening 27 of the lowermost bin 4.

(2) Assuming that the image recording apparatus 1 prints forty documents each of twenty pages, the image recording apparatus 1 first discharges forty sheets 2 of page 20. Accordingly, while moving downward, the indexer 6 distributes one sheet 2 of page 20 to each bin 4 up to the fortieth bin 4 as numbered from above. The sheet 2 released into each bin 4 slides on the bin 4 and is stopped by the stopper member 22.

(3) At the time distribution of the sheets 2 of page 20 to the forty bins 4 is completed, the sheet inlet end 4*a* of the fortieth bin 4 is kept open though the sheet inlet ends 4*a* of the first (uppermost) to thirty-ninth bins 4 have been closed by the spring members 30. Accordingly, the indexer 6 is further moved downward by a small distance, thereby closing the sheet inlet end 4*a* of the fortieth bin 4 by the spring members 30.

(4) Thereafter the side lineup rods 21*a* and 21*b* are moved toward both the reference surfaces L1 and L2, thereby bringing the side edge of the sheet 2 in each bin 4 into alignment with the reference surface L1 while the guide rail 26 is moved toward the sheet inlet ends 4*a* of the bins 4, thereby bringing the trailing edge of the sheet 2 in each bin 4 into abutment against the spring members 30 or into alignment with the reference surface L2.

(5) Then the indexer 6 is returned upward to the position where the sheet discharge port 6*b* thereof is opposed to the sheet inlet end 4*a* of the uppermost bin 4 and distributes one sheet 2 of page 19 to each bin 4 up to the fortieth bin 4 to be superposed on the sheet 2 of page 20 in the similar manner. In this manner, a sheet stack 20 of sheets 2 of pages 1 to 20 is formed on each of the first to fortieth bins 4.

(6) Each time the indexer 6 is moved upward, the inclined surfaces of the hollow resilient members 38 are brought into contact with the trailing edges of the sheet stacks 20 on the respective bins 4 in sequence, thereby lining up the trailing edges of the sheets 2 in each stack 20.

(7) When formation of a sheet stack 20 of sheets 2 of pages 1 to 20 on each of the first to fortieth bins 4 is thus completed, the guide rail 26 is returned to the position shown in FIG. 4. Further the indexer 6 is moved upward beyond the position shown in FIG. 12 so that the sheet inlet ends 4*a* of all the bins 4 are opened.

(8) Thereafter the stapler 7 in the waiting position is moved in a horizontal direction into the path of the indexer 6 and then moved upward to a position where the throat 7*a* of the stapler 7 is positioned in a predetermined position for stapling the sheet stack 20 in the fortieth bin 4, and at the same time, the sheet stack ejector 25 is moved upward into the opening 27 of the fortieth bin 4. Thereafter the guide rail 26 is moved toward the sheet inlet end 4*a* of the bin 4 so that the sheet stack ejector 25 ejects the sheet stack 20 on the fortieth bin 4 beyond the reference surface L2 by a predetermined length, whereby the trailing edge of the sheet stack 20 is inserted into the throat 7*a* of the stapler 7. That the trailing edge of the sheet stack 20 is in the throat of the stapler 7 is detected by a detector (not shown) and the stapler 7 automatically staples the sheet stack 20.

(9) Thereafter the guide rail 26 is returned to the original position together with the sheet stack ejector 25 and the base table 50 of the stapler 7 is moved on the lift 52 to bring a working face (not shown) of the sheet pusher mechanism 49 to the center of the stapled sheet stack 20. Then the sheet pusher mechanism 49 actuates the working face to push the stapled sheet stack 20 into the bin 4. The working face is ejected toward the bin 4 by a cam mechanism (not shown) to push the stapled sheet stack 20 into the bin 4.

(10) Then the stapler 7 is moved upward to a position where the throat 7*a* of the stapler 7 is opposed to the sheet stack 20 in the thirty-ninth bin 4, and at the same time, the sheet stack ejector 25 is brought into the opening 27 of the thirty-ninth bin 4. Thereafter the guide rail 26 is moved toward the sheet inlet end 4*a* of the bin 4 so that the sheet stack ejector 25 ejects the sheet stack 20 on the thirty-ninth bin 4 beyond the reference surface L2 by the predetermined length, whereby the trailing edge of the sheet stack 20 is inserted into the throat 7*a* of the stapler 7. Then the stapler 7 automatically staples the sheet stack 20 and the guide rail 26 is returned to the original position together with the sheet stack ejector 25 and the sheet pusher mechanism 49 on the stapler 7 pushes the stapled sheet stack 20 into the bin 4.

(11) In this manner, the sheet stacks 20 on all the bins 4 are stapled and after completion of the stapling operation, the stapler 7 is returned to the waiting position. Then the sheet stack take-out door 18 is opened and the stapled sheet stacks are taken out.

Though the stapling operation is started from the sheet stack 20 on the lowermost bin 4 in the embodiment described above, the stapling operation may be started from the sheet stack 20 on the uppermost bin 4 after the stapler 7 is once moved to the uppermost bin 4.

As can be understood from the description above, in the sheet sorter S of this embodiment, since the waiting position of the stapler 7 is retracted from the path of travel of the indexer 6 in a direction of width of the sheets 2, the path of travel of the indexer 6 partly overlaps with the waiting position of the stapler 7 as seen laterally to the path of travel of the indexer 6, and the arrangement of bins 4 can be determined independently of existence of the stapler 7. That is, the number of the bins 4 can be increased for a given height of the sheet sorter and the height of the sheet sorter can be reduced for a given number of bins 4.

When the waiting position of the stapler 7 is on the side of the sheet sorter where the operator of the sheet sorter stands when operating the sheet sorter, replacement and/or adjustment of staples can be carried out while the indexer 6 is distributing the sheets 2 to the bins 4, and accordingly interruption and the like of the operation of the sheet sorter can be reduced and the working efficiency is increased.

Further by virtue of the spring members 30 which are fed out and taken up in response to up-and-down movement of the indexer 6 and defines the trailing edge reference surface L2, the trailing edges of the sheets 2 can be precisely aligned with each other on the reference surface L2 without providing each bin 4 with an erected surface defining the trailing edge reference surface as in conventional systems.

Further since the spring members 30 defining the trailing edge reference surface L2 are taken up into the casing 31 as the indexer 6 moves upward, all the bins 4 are free from any member which closes the sheet inlet ends 4*a* so long as the indexer 6 is in its uppermost position and accordingly ejecting the sheet stacks 20 beyond the sheet inlet ends 4*a* by the sheet stack ejector 25 and returning the same into the bins 4 by the sheet pusher mechanism 49 are greatly facilitated.

Further since the side lineup rods 21*a* and 21*b* which push the sheets 2 in the direction of width to bring the side edges of the sheets 2 into abutment against the side is edge reference surface L1, thereby lining up the side edges of the sheets 2 are movable so that they are simultaneously moved toward and away from both the reference surfaces L1 and L2, the lineup rods 21*a* and 21*b* can act on the sheets 2 in optimum positions according to the size of the sheets 2 to be handled. Further since the distance between the rods 21*a* and 21*b* becomes smaller as the rods 21*a* and 21*b* are moved toward the side edge of the sheet 2, the positions in which the rods 21*a* and 21*b* act on the sheets 2 can be further better.

What is claimed is:

1. A sheet sorter for receiving a plurality of sheets discharged from an image recording apparatus, comprising a plurality of bins arranged in a vertical direction each of which receives a plurality of sheets discharged from the image recording apparatus and forms thereon a stack of sheets, a sheet transfer means which transfers the sheets discharged from the image recording apparatus, an indexer which receives the sheets from the sheet transfer means and is movable up and down along the array of sheet inlet ends of the bins to distribute the sheets to the respective bins through the sheet inlet ends thereof to form said stack of sheets, and a stapler which is movable along the path of travel of the indexer independently therefrom to staple the stack of sheets on each bin, wherein the improvement comprises a sheet stack ejector mounted for movement adjacent each of said plurality of sheets, said sheet stack ejector operable to eject at least a portion of the stack of sheets from a selected bin toward the stapler for stapling the stack of sheets as said bin remains stationary, said stapler being positioned a fixed spatial distance from said bin during the ejection of at least a portion of said stack of sheets by said sheet stack ejector, and the stapler being arranged to wait in a waiting position retracted from the path of travel of the indexer in a direction of width of the sheets while the indexer is travelling along the path.

2. A sheet sorter with a stapler as defined in claim 1 in which the waiting position of the stapler is on the side of the sheet sorter where the operator of the sheet sorter stands when operating the sheet sorter.

3. A sheet sorter with a stapler as defined in claim 1, further including a sheet pusher mechanism for returning a stapled sheet stack to the selected bin.

* * * * *